United States Patent [19]

Kovalak, Jr.

[11] Patent Number: 4,802,296

[45] Date of Patent: Feb. 7, 1989

[54] ARCHITECTURAL SIGN SYSTEM

[75] Inventor: Judson L. Kovalak, Jr., Rockford, Mich.

[73] Assignee: SignComp, Inc., Comstock Park, Mich.

[21] Appl. No.: 947,688

[22] Filed: Dec. 30, 1986

[51] Int. Cl.[4] ..... G09F 15/00

[52] U.S. Cl. ..... 40/607; 40/574; 40/606

[58] Field of Search ..... 40/606, 607, 605, 611, 40/574, 642; 52/211-217, 228, 272, 464, 463

[56] References Cited

U.S. PATENT DOCUMENTS

| | | | |
|---|---|---|---|
| 1,455,103 | 5/1923 | Berry | 40/607 |
| 1,496,525 | 6/1924 | Coco | 52/217 |
| 2,545,902 | 3/1951 | Sugar | 52/217 |
| 2,834,071 | 5/1958 | Camerino | 52/217 |
| 2,960,734 | 11/1960 | Collins | 52/217 |
| 3,239,978 | 3/1966 | Parker | 52/217 |
| 3,599,381 | 8/1971 | Gartner | 52/217 |
| 3,707,815 | 1/1973 | Molyneux | 52/213 |
| 3,758,972 | 9/1973 | Egermayer . | |
| 3,848,349 | 11/1974 | Olsen . | |
| 3,863,372 | 2/1975 | Stilling . | |
| 3,875,713 | 4/1975 | Laborde | 52/213 |
| 4,007,552 | 2/1977 | Brooks . | |
| 4,263,738 | 4/1981 | Donatelle | 40/606 |
| 4,265,039 | 5/1981 | Brooks . | |
| 4,641,448 | 2/1987 | Cobb et al. | 40/606 |

FOREIGN PATENT DOCUMENTS

| | | | |
|---|---|---|---|
| 2553217 | 4/1985 | France | 40/606 |
| 2069738 | 8/1981 | United Kingdom | 40/606 |
| 2100044 | 12/1982 | United Kingdom | 40/606 |

OTHER PUBLICATIONS

Signpro Systems brochure entitled "Display Viewpoint".

*Primary Examiner*—Gene Mancene
*Assistant Examiner*—J. Hakomaki
*Attorney, Agent, or Firm*—Price, Heneveld, Cooper, DeWitt & Litton

[57] ABSTRACT

An architectural sign system includes a pair of support columns fabricated as one-piece extrusions and defining an outer surface and an inner surface. An elongated channel opens through the inner surface of each column. The channel includes spaced, parallel sidewalls which define a plurality of opposed reveal grooves. A sign body is formed from a plurality of individual body members. A sign face retainer including a plurality of joined individual retainer members is secured to the sign body. A pair of elongated reveals are attached to opposed sides of the sign body. The reveals include outwardly extending reveal or slide flanges adapted to be disposed within opposed ones of the reveal grooves to provide for selectable reveal widths. The sign body members define elongated hinge grooves. The retainer face members define integral hinge beads dimensioned to be disposed within the grooves so that the sign face may be pivoted to the body to provide access to the interior thereof.

18 Claims, 3 Drawing Sheets

ARCHITECTURAL SIGN SYSTEM

BACKGROUND OF THE INVENTION

The present invention relates to architectural sign systems and more particularly to component sign structures assembled from a plurality of individual extrusions.

Various forms of architectural sign systems are presently available. Such signage may be of the post and panel type which is used to display company, firm names, directions and the like. These signs are typically integrated into or a part of the landscaping of a building site. The signage may be illuminated or nonilluminated. With illuminated systems, access to the sign interior must be provided for maintenance and/or replacement of the lighting system.

In many situations, the architect desires custom signage. In addition, the architect may desire flexibility to change the visual effect of the signage. At many commercial locations, it is necessary to permit changing of the sign face without replacement of the entire sign system. Presently available systems suffer from various problems. These problems include nonstandard components which limit or prevent customization. In addition, present systems suffer from complexity which increases the cost of and difficulty of assembling and fabricating such systems. Complications with maintenance, reliability and unacceptable length of service are also present.

SUMMARY OF THE INVENTION

In accordance with the present invention, the aforementioned problems are substantially reduced or eliminated. Essentially, a component architectural sign system is provided which includes a plurality of standard, individual extrusions which may be cut to a desired length and assembled to provide either an illuminated or nonilluminated structure. The system includes support columns which define an elongated, reveal channel. The channel has opposed sidewalls defining a plurality of reveal grooves. A sign body is fabricated from a plurality of individual body members or extrusions. The body members each include an outer surface and side surfaces. At least one of the side surfaces may define an elongated hinge groove and a water drainage channel. A sign face retainer is assembled from a plurality of individual retainer members. Each retainer member defines an elongated hinge flange having an integral hinge bead dimensioned to be received within the hinge groove. Suitable fasteners retain the hinge bead within the groove. A reveal extrusion includes a base which is securable to a side of the sign body. The reveal extrusion includes outwardly extending slide or reveal flanges. The reveal flanges are dimensioned to be inserted within selected ones of the grooves defined by the support columns. By choosing the desired grooves, the reveal width may be varied to thereby change the visual effect of the sign. A wide variety of custom signs may be manufactured from standard components. Versatility in visual presentation is obtained. Ease of assembly, manufacture and reduced complexity are present.

DETAILED DESCRIPTION OF THE PREFERRED EMBODIMENTS

Figure 1:
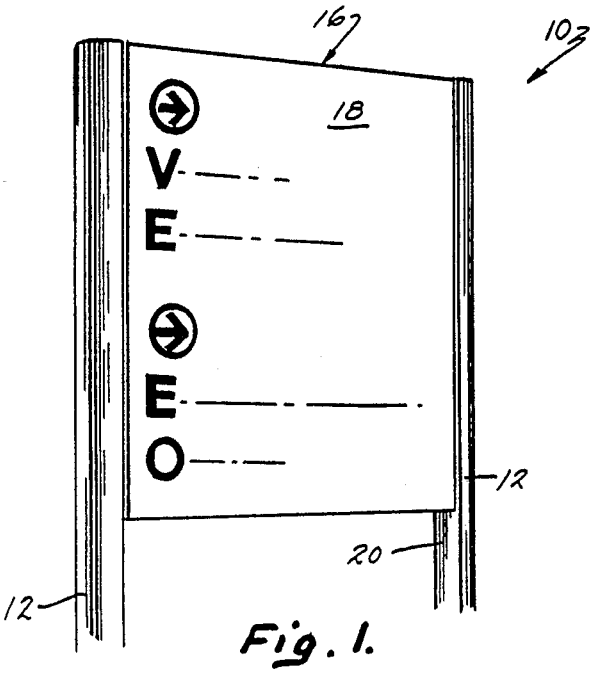
FIG. 1 is a perspective, front elevational view of an architectural sign structure in accordance with the present invention.
Figure 2:
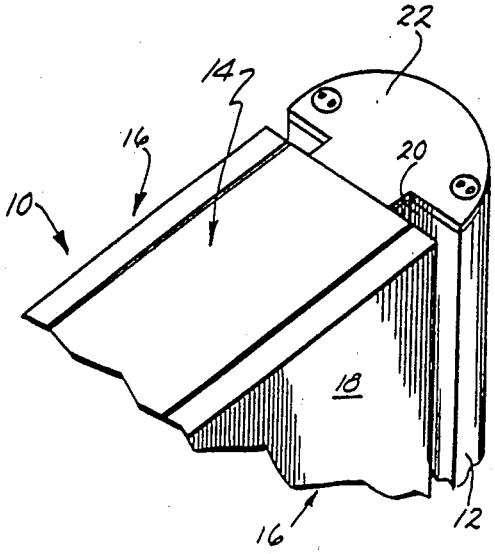
FIG. 2 is a fragmentary, top perspective view of the sign structure of FIG. 1.

FIGS. 1 and 2 illustrate an architectural sign structure or system in accordance with the present invention and generally designated by the numeral 10. System 10 includes a pair of support columns or posts 12. Sign 10 further includes a body 14 and sign face retainers 16 which support sign faces 18. Sign body 14 is secured to support columns 12 at each end by a reveal 20. The tops of the support columns 12 are covered by suitable caps 22.

Figure 4:
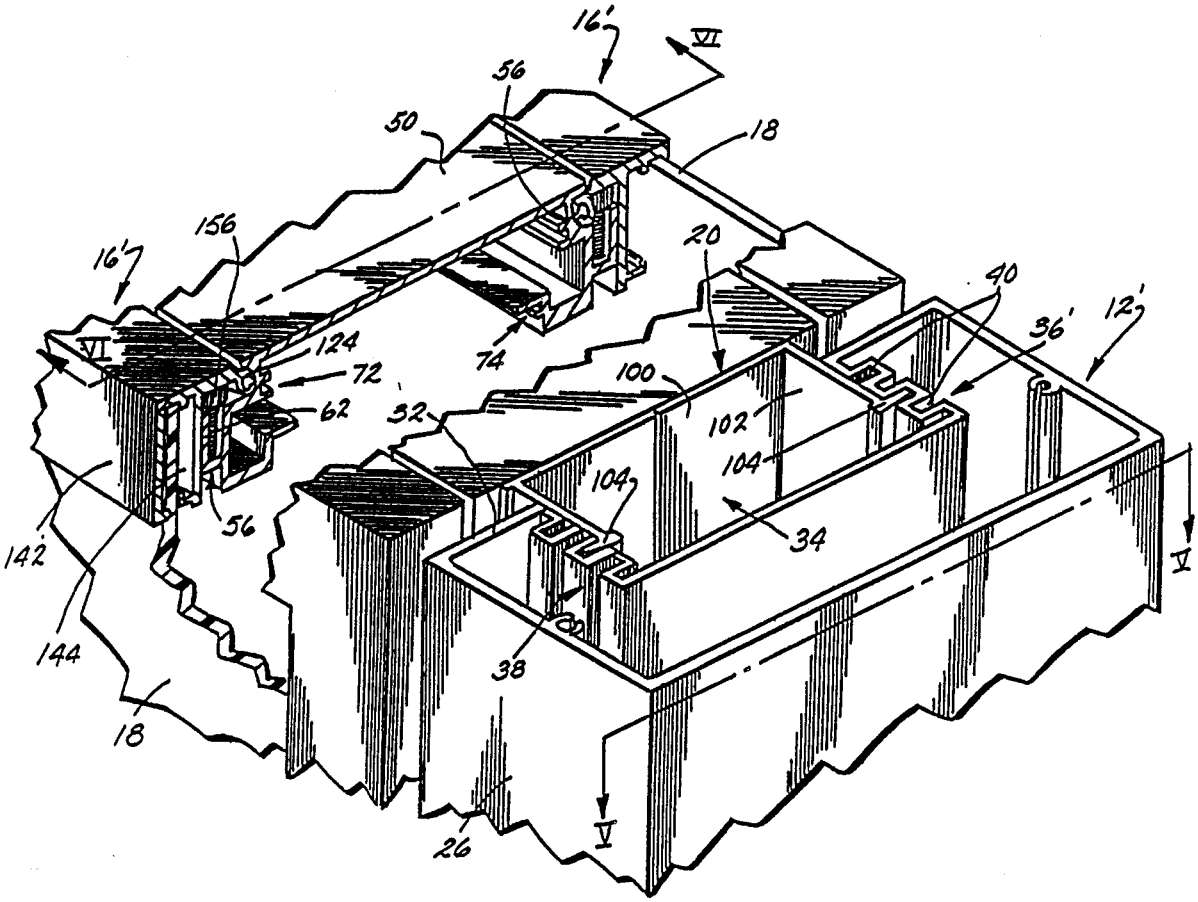
FIG. 4 is a fragmentary, top perspective view of an alternative embodiment in accordance with the present invention.
Figure 5:
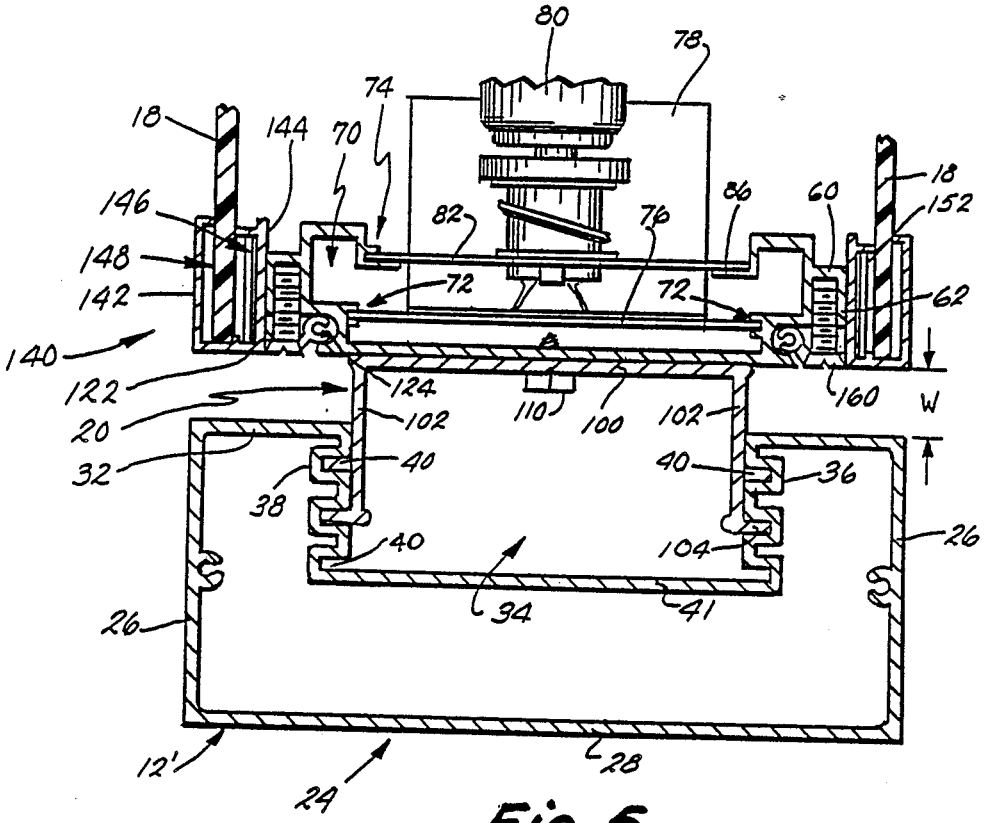
FIG. 5 is a cross-sectional view taken generally along line V—V of FIG. 4.

FIGS. 4 and 5 illustrate an alternative embodiment designated 10' and having support columns 12' and sign face retainers 16'. In describing the embodiments, like numerals are used to designate like parts.

Figure 3:
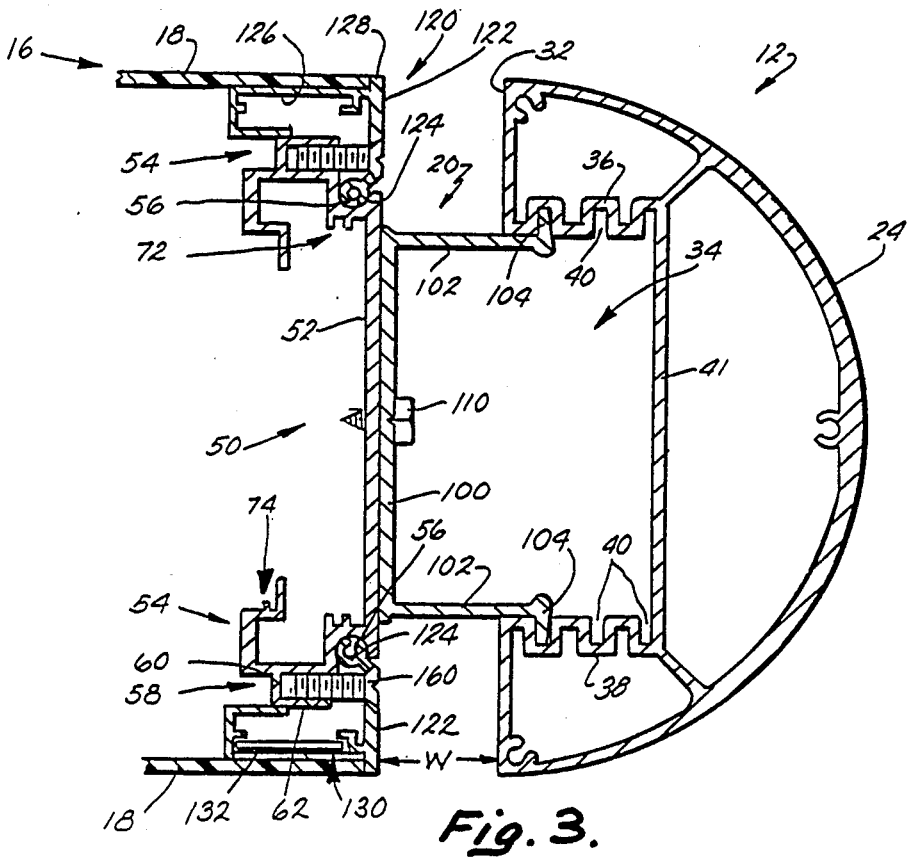
FIG. 3 is a cross-sectional view taken through a support column of a sign structure in accordance with the present invention.

In the embodiment of FIGS. 1–3, support column 12 is a radius column having a generally semicircular horizontal cross section. Column 12 includes an outer surface 24. In the embodiment of FIGS. 4 and 5, support column 12' is generally rectangular in horizontal cross section and includes an outer surface 24 defined by sides 26 and a face 28. Each support column 12, 12' includes an inner surface or face 32. Opening through inner surface 32 is an elongated reveal channel 34. Channel 34 includes spaced, parallel, opposed sidewalls 36, 38 and a base or bottom wall 41. Opposed sidewalls 36, 38 define a plurality of opposed grooves 40. As explained in more detail below, opposed grooves 40 provide a variable reveal width.

In each embodiment, sign body 14 is fabricated from a plurality of individual, standard body members or extrusions 50. Each body member 50 is fabricated as a one-piece extrusion and has a generally channel-shaped horizontal cross section. Extrusion 50 includes an outer surface or wall 52 and side surfaces, sidewalls or configured flanges 54. Each sidewall 54 defines an elongated hinge groove 56 and an integral water drainage channel 58. Channel 58 is formed by an L-shaped flange having a base 60 and an outer leg or wall 62. As best seen in FIG. 5, each body member 50 also defines an electrical raceway 70. Raceway 70 includes opposed ballast bracket channels or grooves 72 and a raceway cover channel or groove 74. In an illuminated sign, a ballast bracket 76 is secured within grooves 72. Bracket 76 supports the lamp ballast 78. A fluorescent light tube 80 is supported by member 50. The electrical raceway 70 is closed by a raceway plate 82. Plate 82 has one lateral edge disposed within groove 74. The opposite lateral edge of plate 82 is secured to a raceway flange 86 by suitable fasteners such as sheet metal screws.

Reveals 20 mount sign body 14 on support posts or columns 12, 12'. As seen in FIGS. 3, 4 and 5, each reveal 20 is generally U-shaped in horizontal cross section and includes a base 100 and opposed legs or sidewalls 102. Formed integral with legs 102 are outwardly extending reveal or slide flanges 104. Reveal 20 is secured to outer surface or wall 52 of the vertical or side body members such as by threaded fasteners 110. As can be seen from a comparison of FIGS. 3 and 5, the reveal width "w" or the spacing between inner surface 32 of the support column and the sign body may be varied from substantially zero to substantially the width of the reveal legs merely by choosing the desired reveal grooves 40. Outwardly extending flanges 104 of reveal 20 are slidably disposed within the opposed grooves 40. In the embodiment shown, three different reveal widths may be selected to change the visual appearance or effect of the architectural signage. In addition, as shown in FIG. 1, cut sections of reveal 20 may be used to close the inner surface of the column 12 when the sign body 14 is supported off of the ground or spaced above the lowermost end of the support columns or posts 12. A cut section of the reveal designated 20' in FIG. 1 is slid into the support column with its reveal flanges in the innermost set of opposed grooves 40. The sign body with its attached reveals 20 is then slid into the desired grooves of the support columns above the reveal sections 20'.

FIGS. 2 and 3 illustrate one embodiment of the sign face retainer 16. In this embodiment, retainer 16 is fabricated or assembled from a plurality of individual retainer members 120. Each retainer member 120 includes an integral retainer or hinge flange 122. Flange 122 terminates in a generally circular hinge bead 124. Hinge bead 124 is dimensioned to be received within hinge groove 56 of body member 50. Retainer member 120 is a bleed face retainer. Member 120 includes a central box-like section having a flat face, bleed surface or peripheral flange 126 which terminates in an abutment or shoulder 128. Sign face 18 has a peripheral edge portion which engages or rests against surface 126 and an edge which abuts shoulder 128. Sign face 18 is joined to surface 126 by any suitable means, such as with threaded fasteners, adhesives or by welding. Sign face 18 in this embodiment bleeds to the edge of the sign face retainer.

Retainer 120, which is formed as a one-piece extrusion, also defines an angle channel 130 for receipt of a suitable corner key or angle 132. In fabricating the sign retainer 16, the individual members 120 are cut to the desired length. The corners are then mitered and the members 120 are assembled using the corner keys 132 to define a generally rectangular frame. The keys or angles may be welded to the members or otherwise secured in any suitable fashion.

Figure 6:
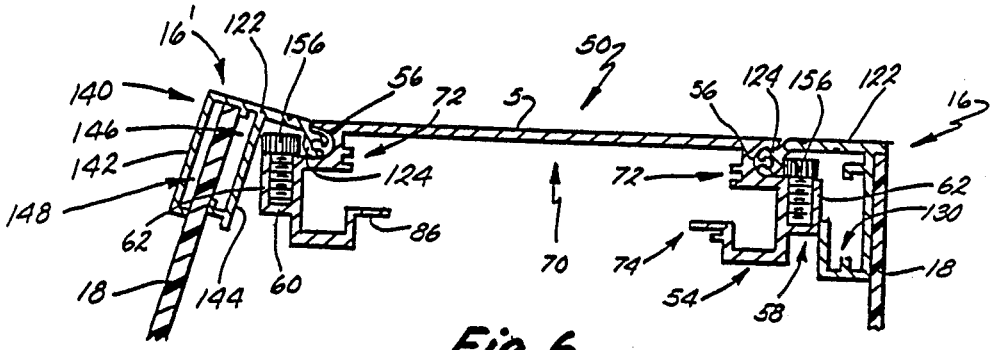
FIG. 6 is a cross-sectional view taken generally along line VI—VI of FIG. 4.

Sign face retainer 16', illustrated in FIGS. 4, 5 and 6, is fabricated from a plurality of individual one-piece extrusions or retainer members 140. Members 140 also include an elongated hinge flange 122 which terminates in an integral hinge bead 124. In addition, retainer members 140 include an outer peripheral flange 142 and an inner flange 144. Flange 144 defines a corner key or angle channel 146. Channel 146 and peripheral flange 142 define a slot or sign face groove 148 which slidably receives sign face 18. The individual members 140 are cut to the desired length with the ends mitered. Members 140 are then assembled using the corner keys 152 (FIG. 5).

As seen in FIG. 6, retainers 16 and 16' are hingedly secured to a body member 50 which forms the top member of the rectangular body. A plurality of longitudinally spaced hinge fasteners 156 are threaded into water channel 58 at longitudinally spaced positions along the length of the channel. The upper retainer member 120 or 140 of retainers 16 or 16' may then be slid into position on member 50 with the hinge bead 124 disposed within hinge groove 56. Fasteners 156 capture bead 124 within groove 56 and permit outward pivotal movement of the entire sign face. The sign face retainer is held in a closed position on main body 14 by threaded fasteners 160, as shown in FIGS. 3 and 5. Fasteners 160 may be inserted along the sides of the retainer structure and/or along the bottom of the retainer structure. To gain access to the interior of the sign for maintenance or replacement of the lights, fasteners 160 are removed and the face retainer is pivoted outwardly away from body 14.

The component sign system in accordance with the present invention readily provides for customization. Since the system employs standard extrusions, the extrusions may be cut to a desired length to form the particular size sign needed. This provides great versatility to the sign manufacturer and to the architect in the selection of such signage. The reveal structure in combination with the uniquely configured support posts provides for a readily variable reveal width to change the appearance or visual effect of the signage.

In view of the above description, those of ordinary skill will undoubtedly envision various modifications to the structure which will not depart from the inventive concepts disclosed. For example, the structure is readily adapted to either single or double-sided signs. In a single-sided embodiment, the individual body members would be provided with a nonconfigured or flat back peripheral flange. A simple sheet metal back would be secured to such flange. The hinge bead groove and other structure may be eliminated. Further, the component nature of the sign system readily adapts it to either a bleed face retainer 16 or framed face sign retainer 16'. The reveal extrusion, as explained above, readily fills in the columns below the sign panel to provide a solid architectural look. The system provides the option of multiple removable panels. Individual panels may be supported on the retainer using an intermediate divider. The sign panel or face 18 is readily changed. All that need be done is to remove one of the retainer members 140. Sign face 18 may then be slid out and replaced with a new face. In assembling the individual components, they may be welded or removable fasteners may be used. A fairly watertight structure is provided. Using welding techniques to fabricate the completed structure in combination with the integral drain channel eliminates water collection problems within the sign structure. The components provide an integrated raceway which may be completely enclosed. The system in accordance with the present invention significantly reduces manufacturing difficulties, assembly difficulties and provides for easy access and maintenance. The individual components or extrusions are readily fabricated from aluminum. A component system in accordance with the present invention will provide reliable and long service.

It is expressly intended, therefore, that the above description should be considered only that of the preferred embodiments. The true spirit and scope of the present invention may be determined by reference to the appended claims.

The embodiments of the invention in which an exclusive property or privilege is claimed are defined as follows.

1. An architectural sign structure comprising:

a pair of support columns, each column fabricated as a one-piece extrusion defining an outer surface, an inner surface and an elongated channel-shaped groove opening through said inner surface, said channel-shaped groove including spaced, parallel sidewalls, said sidewalls defining a plurality of opposed reveal grooves;

a sign body including a plurality of body members defining the sides thereof;

a pair of elongated reveals, each reveal being attached to opposed sides of said sign body and including outwardly extending slide flanges, said slide flanges being selectively disposed within opposed ones of said reveal grooves to provide a variable reveal; and a sign face retainer joined to said sign body.

2. An architectural sign structure as defined by claim 1 wherein each of said reveals is generally U-shaped in horizontal cross section having a base and legs, said reveal slide flanges extending outwardly from a free end of each of said legs.

3. An architectural sign structure as defined by claim 1 wherein each of said body members is an integral one-piece extrusion defining an outer face and side faces, each of said side faces defining an elongated hinge groove.

4. An architectural sign structure as defined by claim 3 wherein said sign face retainer includes a plurality of retainer members, each retainer member being an elongated extrusion defining an elongated hinge flange having an integral hinge bead disposed within one of said elongated hinge grooves.

5. An architectural sign structure as defined by claim 4 further including a plurality of hinge retainer fasteners connected to one of said body members to capture and retain the hinge bead of one of said retainer members within a respective one of said hinge grooves.

6. An architectural sign structure as defined by claim 5 wherein said body members further define an elongated drainage channel adjacent said hinge grooves, said hinge retainer fasteners being threaded within said drainage channel of said one of said body members.

7. An architectural sign structure as defined by claim 6 wherein said retainer members each define a sign face groove and said system further includes a rigid sign face having a peripheral edge slidably disposed within said sign face grooves.

8. An architectural sign structure as defined by claim 6 wherein each of said retainer members defines a bleed surface and said system further includes a rigid sign face having a peripheral edge abutting said bleed surface.

9. An architectural sign structure as defined by claim 2 wherein each of said support columns is generally semicircular in cross section.

10. An architectural sign structure as defined by claim 2 wherein each of said support columns is generally rectangular in cross section.

11. An architectural sign structure as defined by claim 3 wherein each of said body members defines an electrical wire raceway having opposed walls which define ballast bracket grooves.

12. An architectural sign structure as defined by claim 6 wherein each of said reveals is generally U-shaped in horizontal cross section having a base and legs, said reveal slide flanges extending outwardly from a free end of each of said legs.

13. An architectural sign structure as defined by claim 12 wherein said retainer members each define a sign face groove and said system further includes a rigid sign face having a peripheral edge slidably disposed within said sign face grooves.

14. An architectural sign structure as defined by claim 12 wherein each of said retainer members defines a bleed surface and said system further includes a rigid sign face having a peripheral edge abutting said bleed surface.

15. An architectural sign structure as defined by claim 13 wherein each of said support columns is generally semicircular in cross section.

16. An architectural sign structure as defined by claim 13 wherein each of said support columns is generally rectangular in cross section.

17. An architectural sign structure as defined by claim 14 wherein each of said support columns is generally semicircular in cross section.

18. An architectural sign structure as defined by claim 14 wherein each of said support columns is generally rectangular in cross section.

* * * * *